US006772767B2

(12) United States Patent
Mua et al.

(10) Patent No.: US 6,772,767 B2
(45) Date of Patent: Aug. 10, 2004

(54) PROCESS FOR REDUCING NITROGEN CONTAINING COMPOUNDS AND LIGNIN IN TOBACCO

(75) Inventors: John-Paul Mua, Macon, GA (US); Brad L. Hayes, Macon, GA (US); Kenneth J. Bradley, Jr., Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 10/237,837

(22) Filed: Sep. 9, 2002

(65) Prior Publication Data

US 2004/0045565 A1 Mar. 11, 2004

(51) Int. Cl.[7] ..... A27B 15/24

(52) U.S. Cl. ..... 131/297; 131/300; 131/309; 131/290

(58) Field of Search ..... 131/290, 297, 131/298, 300, 309, 310

(56) References Cited

U.S. PATENT DOCUMENTS

| | | | | |
|---|---|---|---|---|
| 2,112,421 | A | | 7/1938 | Hainkinson |
| 2,341,535 | A | | 2/1944 | Eelizte |
| 3,851,653 | A | | 12/1974 | Rosen |
| 4,366,823 | A | | 1/1983 | Rainer et al. |
| 4,388,933 | A | * | 6/1983 | Rainer et al. ..... 131/293 |
| 4,649,113 | A | | 3/1987 | Gould |
| 4,716,911 | A | | 1/1988 | Poulose et al. |
| 4,941,484 | A | | 7/1990 | Clapp et al. |
| 4,957,599 | A | | 9/1990 | Chou et al. |
| 5,601,097 | A | | 2/1997 | De Grandpre et al. |
| 6,258,209 | B1 | | 7/2001 | Stohrer et al. |

* cited by examiner

*Primary Examiner*—Dionne A. Walls
(74) *Attorney, Agent, or Firm*—Charles G. Lamb; John F. Salazar; Middleton Reutlinger

(57) ABSTRACT

A process for reducing lignin and nitrogenous content in tobacco lamina and tobacco fiber material, including whole leaf, stems, scraps, fines and lamina, as well as burley leaf and stem, in an extraction with a solution containing hydrogen peroxide and an alkali metal hydroxide. The treated tobacco may then be further processed for use in cigarettes and other smoking articles.

7 Claims, 1 Drawing Sheet

PROCESS FOR REDUCING NITROGEN CONTAINING COMPOUNDS AND LIGNIN IN TOBACCO

BACKGROUND OF THE INVENTION

1. Field of the Invention

This invention relates generally to tobacco and tobacco smoking materials and methods of making same. More particularly, the present invention relates to the materials and methods that provide tobacco materials with reduced lignin and nitrogenous content.

2. Description of the Related Art

Tobacco material contains various nitrogenous compounds that can adversely affect its smoke quality. Among these nitrogenous compounds are proteins, amino acids and certain alkaloids, such as nicotine, nornicotine, anabasine and anatabine. The smoke quality of tobacco is adversely affected particularly by heterocyclic and aromatic amines, and tobacco specific nitrosamines (TSNA), as well as other compounds formed by pyrolysis or transfer of these nitrogenous compounds. Tobacco processing sometimes includes steps in which the nitrogen content of the tobacco is reduced so as to improve the smokability of the tobacco. However, nitrogenous compounds are difficult to extract from cured tobacco lamina, stem, and fiber cell walls. Many of the current processes used to reduce nitrogen content in tobacco material employ enzymatic compounds and microbial agents to break down the proteins and other nitrogen-containing compounds within the tobacco. However, disadvantages arise from the use of such enzymatic compounds and agents. In particular, enzymes are expensive, pH sensitive and degrade proteins into amino acids which tend to remain with the tobacco material. It is also thought that enzymatic compounds leave residues on tobacco material after processing. Furthermore, microbial agents used in treating tobacco tend to cause unwanted reactions that generate undesirable byproducts. Moreover, in many of these tobacco treatments, the tobacco disintegrates or easily breaks into small pieces.

Therefore, there is a need to provide a process by which the nitrogen content of tobacco material may be reduced without leaving residues or undesirable by-products and the break-down of tobacco solid materials is reduced.

SUMMARY OF THE INVENTION

The present invention relates to a method for providing a tobacco material having a reduced lignin and nitrogenous content. The tobacco material in the form of flue cured and burley whole leaf lamina as well as stems, fines, or scraps is contacted with an aqueous solvent. The resulting liquid extract is separated from a tobacco fiber portion. The tobacco fiber portion is then contacted with a solution containing an alkali metal hydroxide, such as sodium hydroxide and/or potassium hydroxide, and hydrogen peroxide. This solution is also separated from the tobacco fiber portion. The tobacco fiber portion may then be washed, refined and further processed for use in smoking articles, such as cigarettes. The reduction of lignin and nitrogenous compounds in the tobacco material provides for improved smokability and a reduction in nitrogen containing pyrolitic products emitted from smoking articles which contain the tobacco material.

It is an object of the present invention to provide a tobacco product with reduced levels of lignin and nitrogenous compounds.

It is another object of the present invention to provide a method of making a tobacco product with reduced levels of lignin and nitrogenous compounds.

It is a further object of the present invention to provide a method of treating tobacco which minimizes the break-up of tobacco solid materials.

More particularly, the present invention is directed to a method for reducing the lignin and nitrogenous content of tobacco material, including cured tobacco whole leaf, fines, scraps, stems and lamina, as well as burley leaf and stem, comprising the steps of contacting tobacco material with a first aqueous solvent, such as water, at a temperature of about 60° C. to 8° C. for about 0.5 to 1 hours; separating an aqueous tobacco extract from a tobacco fiber portion; contacting this washed tobacco fiber portion with a solution containing from 1% to 5% (weight/weight) alkali metal hydroxide and from 2.5% to 12% (weight/weight) hydrogen peroxide at a temperature of about 25° C. to 120° C. for about 0.5 to 4 hours; and, separating the resulting solution from the tobacco fiber portion. The resulting tobacco product is then dried and used in the manufacture of cigarette articles. Alternatively, the extract or a portion thereof, may be added to the tobacco product before drying.

A better understanding of the present invention will be realized from the hereafter processes and the Examples following such description.

DESCRIPTION OF THE PREFERRED EMBODIMENT

Figure 1:
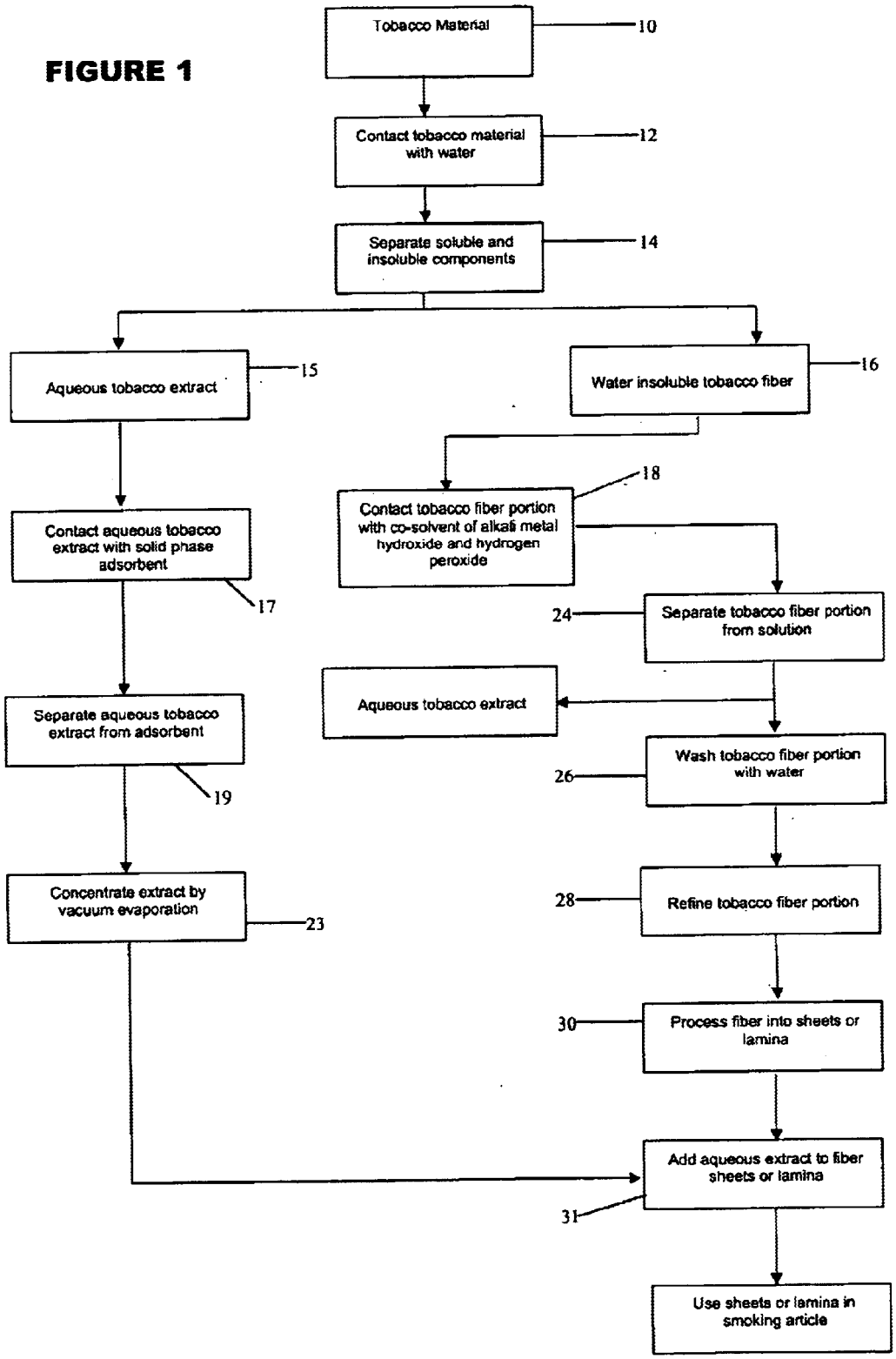
FIG. 1 is a schematic of the process steps representative of the present invention.

In a preferred method of carrying out the lignin and nitrogen reduction process of the present invention, tobacco materials (10) in the form of flue cured and burley stems, scraps. fines, and/or lamina are contacted with a first aqueous solvent (12) such as water, at a temperature of about 60° C. to 80° C. for about 0.5 to 1 hour. The contacting of the tobacco with the water (12) may be conducted in a tank or similar mixing vessel in which the water and tobacco are heated and agitated. The resulting aqueous tobacco extract, containing flavor compounds, s separated from the tobacco fiber portion, preferably by centrifugation (14). The tobacco/water slurry may be pumped into a centrifuge from the mixing vessel and centrifugally separated therein. Once removed from the tobacco fiber or lamina portion, the aqueous tobacco extract (15) may be reserved fro reapplication to the fiber with or without separate processing. In one embodiment, the aqueous tobacco extract (15) may be contacted with a solid phase absorbent (17), such Bentonite or a cationic resin, in a vessel and then separated therefrom by centrifugation (10) or a similar separation process well known in the art. In another embodiment, the aqueous tobacco extract (15) may be pumped or passed through specialty filters, membranes, or column packed adsorbent/adsorbent materials to remove soluble nitrogenous components, such as nitrates, proteins arid nitrosamines (TSBAs), and polyphenolic compounds, and the like. The nitrogen-reduced aqueous tobacco extract containing flavor compounds may then be concentrated (23) by vacuum evaporation, and added beck to the reconstituted tobacco paper (31).

The lignin and nitrogen content of the tobacco fiber or lamina portion (16) separated from the aqueous tobacco extract (15) may be reduced by contacting the tobacco fiber or lamina portion (16) with a co-solvent solution containing an alkali metal hydroxide, such as sodium hydroxide and/or potassium hydroxide, and hydrogen peroxide (18). The tobacco fiber or lamina portion (16) may be loaded into a tank or similar mixing vessel. In one embodiment, a co-solvent containing from about 1.0% to 5.0% (weight/weight) sodium hydroxide and 2.5% to 12.0% hydrogen peroxide (weight/weight) of tobacco fiber, preferably from 4.0% to 8.0% hydrogen peroxide, is charged to the vessel and contacted with the washed tobacco fiber portion at a temperature of about 25° C. to 80° C. for 0.5 to 2.0 hours for lamina and from a temperature of about 70° C. to 120° C. for about 0.5 to 4.0 hours for tobacco fiber. Afterward, the solution may be separated from the tobacco fiber or lamina portion by any means well known in the art (24), such as, for example, by pumping the slurry to a centrifuge wherein the fiber is centrifugally separated from the solution. The tobacco fiber or lamina portion may then be washed with a second aqueous solvent, such as water, as noted by numeral (26), and further refined (28). The tobacco fiber or lamina portion may then be processed into sheets (30), to which may be added the lignin-nitrogen reduced aqueous tobacco extract (31). When sheets or lamina from the aforementioned process are compared to only washed sheets or lamina, there is a 35–90% reduction in Kjeldahl nitrogen and a 23–45% reduction in lignin.

Additionally, potassium hydroxide (KOH) may be included in the solution with which the tobacco fiber portion is contacted. The tobacco fiber or lamina portion may be contacted with a solution containing potassium hydroxide and hydrogen peroxide. The solutions set forth may contain about the same amount of potassium hydroxide as sodium hydroxide.

In particular, tobacco sheets and lamina formed from tobacco material treated with alkali metal hydroxide and hydrogen peroxide is stronger than tobacco fibers and lamina processed by conventional methods. Also, this tobacco product exhibits a texture and a density that are similar to that exhibited by flue cured tobacco leaf. This tobacco product, when cut, will not crumble as easily as similar tobacco products formed by conventional methods. Therefore, less tobacco is wasted in the process of making smoking articles such as cigarettes. Thus, tobacco treated by the above described process provides advantages in the cigarette making process over conventionally treated tobacco.

EXAMPLES

For a better understanding of the present invention, the following Examples are incorporated herein to illustrate the present invention with no intention of being unduly limited thereby.

Control 1 and Example 1A, 1B

A 2.8 kg mixture of tobacco materials, including flue-cured and burley tobacco scraps, stems, laminae and fines having a nitrogen content of 2.09% was extracted with water at 70° C. for 30 minutes to 120 minutes as known in the art. Following centrifugation, the liquid extract was further treated with adsorbent (e.g. diatomaceous clay, activated charcoal, clyodextrin, or combinations thereof) or absorbent (cellulose acetate) to remove nitrogenous compounds, and then concentrated by vacuum evaporation. The resultant washed fiber was further extracted to remove lignin and nitrogenous compounds, as mentioned below. From the washed fibers, 350 g portions were then loaded into vessel containing 2.8–4.2 L of an alkaline-peroxide solution, comprising 2.5% (w/w) sodium hydroxide and 7.5% (w/w) hydrogen peroxide. The alkaline-peroxide solution containing the tobacco material was then heated to 70° C. and held for 0.5–1 h while being agitated. After each period of heating and agitation, the liquid was separated from the tobacco fiber portion through centrifugation. A sample of the fibrous solids was then rinsed with water and dried for 24 h at 35° C. The sample was then tested for lignin (Kappa number) and Kjeldahl nitrogen content and found to have a lignin content of 47.1–45.7% and a Kjeldahl nitrogen content of 0.77–0.80%, exhibiting a reduction of 23.3% to 25.5% (d.w.b) lignin and a 47.7–49.9% (d.w.b) Kjeldahl nitrogen from an initial Control 1 content of 61.4% and 1.53% for lignin and Kjeldahl nitrogen, respectively, as shown in Table I. The fibrous material was then refined and formed into paper-like sheets on a Fourdrinier type wire paper making machine. Concentrated extracts as described above were finally mixed with glycerol and added back to some of the sheets, as known in the art, before being dried at 90° C. for 3–5 minutes.

Examples 2A, 2B

These examples were carried out in a similar manner and with the same quantities of materials as in Examples 1A, 1B, except that tobacco materials in alkaline-peroxide solutions were heated to 90° C. and held for 1 h with agitation. Another exception was that one solution contained 4.2% (w/w) sodium hydroxide and 8.3% (w/w) hydrogen peroxide, while another contained 8.3% hydrogen peroxide only. The resulting fiber from the alkaline-peroxide extraction had a 30.5% reduction in lignin and a 62.8% reduction in Kjeldahl nitrogen, while the peroxide extracted fiber had a 18.6% and 20.9% reduction in lignin and Kjeldahl nitrogen, respectively.

Examples 3A, 3B

These examples were carried out in a similar manner and with the same quantities of materials as in Examples 1A, 1B, the only changes being that tobacco materials and solutions were heated to 120° C. and held for 30 minutes. Another change was that one solution contained 2.5% sodium hydroxide and 7.5% hydrogen peroxide, while another solution contained 8.3% sodium hydroxide only. The fibrous materials from the hydroxide treatment gave a 14.5% reduction in lignin and 85.5% reduction in nitrogen, whereas the alkaline-peroxide treatment gave a 21.8% and 56.2% reduction in lignin and nitrogen content, respectively.

Control 2 and Examples 4A, 4B

A 1.9 kg batch of shredded burley stems having a Kjeldahl nitrogen content of 2.72% was extracted with water at 70° C. for 30 minutes as known in the art. Following centrifugation, the liquid extract was either discarded or further treated with an adsorbent (e.g. diatomaceous clay, activated charcoal, cylodextrin, or combinations thereof or absorbent (cellulose acetate), or passed through a membrane/filters, to remove nitrogenous compounds, and then concentrated by vacuum evaporation. The resultant washed fiber, having a 66.4% lignin and 2.25% nitrogen content, was further extracted to remove lignin and nitrogenous compounds, as mentioned below. From the washed fibers, 450 g portions were then loaded into a vessel containing 2.8–4.2 L of an alkaline-peroxide solution, comprising either of 5.0% (w/w) potassium hydroxide (KOH) and 10.0% (w/w) hydrogen peroxide ($H_2O_2$) or 2.5% (w/w)

KOH and 7.5% (w/w) ($H_2O_2$). The former alkaline-peroxide solution containing the tobacco material was then heated to 90° C. and held for 0.5 h, whereas the latter was heated to 120° C. and held for 0.5 h while being agitated. After each period of heating and agitation, the liquid was separated from the tobacco fiber portion through centrifugation. Each sample of the fibrous solids was then rinsed with water and dried for 24 h at 35° C. Each sample was then tested for lignin (Kappa number) and Kjeldahl nitrogen content. When compared to the washed fiber Control 2 shown in Table I, the fibrous material treated at 90° C. for 30 minutes had a reduction of 45.2% for lignin and a >90% for nitrogen, while the material treated at 120° C. had a reduction of 35.8 and >90% for lignin and Kjeldahl nitrogen, respectively. Concentrated extract as described above was finally mixed with glycerol and sprayed back on the shredded fibrous material in a rotating vessel chamber before being dried at 90° C. for 5–10 minutes.

Control 3 and Examples 5A, 5B

These examples were carried out in a similar manner and with the same quantities of materials as in Examples 4A, 4B, except that shredded flue-cure stem was substituted for shredded burley stem. The resulting fiber from the alkaline-peroxide (5.0 vs. 10.0%) extraction at 90° C. for 0.5 h had a reduction of 43.1% lignin and a >88.8% nitrogen when compared to control 3 values, shown in Table I. The resulting fiber from the alkaline peroxide (2.5 vs. 7.5%) extraction at 120° C. for 0.5 h had a reduction of 38.6% lignin and >88.8% nitrogen when compared to Control 3 values, shown in Table I.

Control 4 and Examples 6A, 6B

These examples were carried out in the same manner as in Example 4 and with the same quantities of materials as in Examples 1A, 1B, the only changes being that a mixture of flue-cure and burley laminae (17–22 cuts per inch$^2$) was the staring material. Other changes included heating vessel contents to 90° C. for 0.5 h, and using alkaline-peroxide solutions containing either 3.5% NaOH and 6.0% $H_2O_2$ or 6.0% NaOH and 11.5% $H_2O_2$. Resulting fiber from the alkaline-peroxide (3.5 vs. 6.0%) extraction at 90° C. for 0.5 h had a reduction of 36.6% lignin and 59.7% nitrogen when compared to Control 4 values, shown in Table I. The resulting fiber from the alkaline-peroxide (6.0 vs. 11.5%) extraction at 90° C. fro 0.5 h had a reduction of 43.5% lignin and 69.8% nitrogen when compared to Control 4 values, shown in Table I.

Control 5 and Examples 7A, 7B

These examples were carried out in the same manner as in Examples 4A, 4B, and with the same quantities of materials as in Examples 1A, 1B, the only changes being that burley lamina (17–22 cuts per inch$^2$) was the staring material. Another change was holding extraction vessel contents at 25° C. for 2 h, and using alkaline-peroxide solution containing 1.25% NaOH and 3.75% $H_2O_2$ or heating vessel contents to 70° C. and holding 0.5 h, and using 2.5% NaOH and 7.5% $H_2O_2$. Resulting fiber from the alkaline-peroxide (1.25 vs. 3.75%) extraction at 25° C. for 2 h had a reduction of 14.5% lignin and 49.9% nitrogen when compared to Control 5 values, shown in Table I. The resulting fiber from the alkaline-peroxide (2.5 vs. 7.5%) extraction at 70° C. for 0.5 h had a reduction of 29.2% lignin and 63.5% nitrogen when compared to Control 5 values, shown in Table I.

Control 6 and Examples 8A, 8B

These examples were carried out in the same manner and same quantities as in Examples 7A, 7B, the only changes being that flue-cure lamina (17–22 cuts per inch$^2$) was the staring material. Resulting fiber from the alkaline-peroxide (1.25 vs. 3.75%) extraction at 25° C. for 2 h had a reduction of 16.6% lignin and 50.4% nitrogen when compared to Control 6 values, shown in Table I. The resulting fiber from the alkaline-peroxide (2.5 v. 7.5%) extraction at 70° C. for 0.5 h had a reduction of 28.8% lignin and 43.0% nitrogen when compared to Control 6 values, shown in Table I.

TABLE I

| | Reductions in Kjeldahl nitrogen and lignin of tobacco extracted with alkaline-peroxide solutions | | | | | | | |
|---|---|---|---|---|---|---|---|---|
| Starting material | Extraction Temp. (° C.) | Time (min) | % (w/w) solution (dry weight basis) Alkali (NaOH or KOH) | Peroxide ($H_2O_2$) | % Kjeldahl nitrogen (dwb) | % Nitrogen reduction | % Lignin (Kappa number) | % Lignin reduction |
| Mixed tobacco materials | | | | | | | | |
| Control 1 | 70 | 30 | — | — | 1.53 | — | 61.4 | — |
| Aqueously (ag) extracted material (AE) | | | | | | | | |
| 1A | 70 | 30 | 2.5 | 7.5 | 0.80 | 47.7 | 47.1 | 23.3 |
| 1B | 70 | 120 | 2.5 | 7.5 | 0.77 | 49.7 | 45.7 | 25.5 |
| 2A | 90 | 60 | — | 8.3 | 1.21 | 20.9 | 50.2 | 18.6 |
| 2B | 90 | 60 | 4.2 | 8.3 | 0.48 | 62.8 | 42.7 | 30.5 |
| 3A | 120 | 30 | 2.5 | 7.5 | 0.67 | 56.2 | 48.0 | 21.8 |
| 3B | 120 | 30 | 8.3 | — | 0.22 | 85.6 | 52.5 | 14.5 |

TABLE I-continued

| Starting material | Extraction Temp. (° C.) | Time (min) | % (w/w) solution (dry weight basis) Alkali (NaOH or KOH) | Peroxide ($H_2O_2$) | % Kjeldahl nitrogen (dwb) | % Nitrogen reduction | % Lignin (Kappa number) | % Lignin reduction |
|---|---|---|---|---|---|---|---|---|
| | Reductions in Kjeldahl nitrogen and lignin of tobacco extracted with alkaline-peroxide solutions | | | | | | | |
| Shredded Stems | | | | | | | | |
| Control 2 | 70 | 30 | — | — | 2.25 | — | 66.4 | — |
| Aq. Extracted burley (BAE) | | | | | | | | |
| 4A | 90 | 30 | 5.0 | 10.0 | Bcl* (0.22) | 90.2 | 36.4 | 45.2 |
| 4B | 120 | 30 | 2.5 | 7.5 | Bcl (0.22) | 90.2 | 42.6 | 35.8 |
| Control 3 | 70 | 30 | — | — | 1.96 | — | 60.6 | — |
| Aq Extracted flue-cure (FAE) | | | | | | | | |
| 5A | 90 | 30 | 5.0 | 10.0 | Bcl (0.22) | 88.8 | 34.5 | 43.1 |
| 5B | 120 | 30 | 2.5 | 7.5 | Bcl (0.22) | 88.8 | 37.2 | 38.6 |
| Control 4 | 70 | 30 | — | — | 2.92 | — | 61.5 | — |
| Aq Extracted mixed flue-cure/ burley (LAE) | | | | | | | | |
| 6A | 90 | 30 | 3.5 | 6.0 | 1.18 | 59.6 | 39.2 | 36.6 |
| 6B | 90 | 30 | 6.0 | 11.5 | 0.88 | 69.8 | 34.7 | 43.5 |
| Control 5 | 70 | 30 | — | — | 3.95 | — | 62.3 | — |
| Aq Extracted burley (BLAE) | | | | | | | | |
| 7A | 25 | 120 | 1.25 | 3.75 | 1.98 | 49.9 | 53.3 | 14.5 |
| 7B | 70 | 30 | 2.5 | 7.5 | 1.47 | 63.5 | 44.1 | 29.2 |
| Control 6 | 70 | 30 | — | — | 2.57 | — | 60.4 | — |
| Aq Extracted flue cure (FLAE) | | | | | | | | |
| 8A | 25 | 120 | 1.25 | 3.75 | 1.45 | 43.8 | 50.4 | 16.6 |
| 8B | 70 | 30 | 2.5 | 7.5 | 1.13 | 56.0 | 43.0 | 28.8 |

*BELOW CALIBRATION LIMIT

From the Examples it is seen that a significant reduction of both lignin and nitrogen is obtained by contacting tobacco with a mixture of alkali metal hydroxide and hydrogen peroxide from 1% to 5% by weight in a solution and the hydrogen peroxide is from 2.5% to 12%.

The foregoing detailed description and Examples are given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A method of making a tobacco material with reduced levels of lignin, and nitrogenous compounds comprising:

(a) contacting a tobacco material with a first aqueous solvent at a temperature of about 250° C. to 80° C. for about 0.5 to 2 hours to provide an aqueous tobacco extract and a tobacco fiber portion;

(b) separating said aqueous tobacco extract from said tobacco fiber portion;

(c) contacting at a temperature from about 25° C. to 120° C. said tobacco fiber portion with a solution containing hydrogen peroxide and an alkali metal hydroxide wherein said solution contains said hydrogen peroxide in a concentration of from 2.5% to 12.0% (w/w) and said alkali metal hydroxide is from about 1% to 5% (w/w); and, (d) separating said solution from said tobacco fiber portion.

2. The method of claim 1, further comprising:

(e) contacting said tobacco fiber portion with a second aqueous solvent.

3. The method of claim 1 wherein said tobacco is lamina.

4. The method of claim 1, wherein said alkali metal hydroxide is sodium hydroxide.

5. The method of claim 4, wherein said sodium hydroxide is from about 4% to 8 (w/w).

6. The method of claim 4, wherein said alkali metal hydroxide is potassium hydroxide.

7. The method of claim 6, wherein said potassium hydroxide is from about 4% to 8% (w/w).

* * * * *

UNITED STATES PATENT AND TRADEMARK OFFICE

CERTIFICATE OF CORRECTION

PATENT NO. : 6,772,767 B2
APPLICATION NO. : 10/237837
DATED : August 10, 2004
INVENTOR(S) : Mua et al.

It is certified that error appears in the above-identified patent and that said Letters Patent is hereby corrected as shown below:

Column 2, line 13:
Delete "8°c" and insert - - 80°C - -

Claim 1, section (a):
Delete "250°C" and insert - - 25°C - -

Signed and Sealed this

Fifth Day of September, 2006

JON W. DUDAS
*Director of the United States Patent and Trademark Office*